US010945061B2

(12) United States Patent
Holliday

(10) Patent No.: US 10,945,061 B2
(45) Date of Patent: Mar. 9, 2021

(54) ACOUSTIC PROTECTIVE COVER INCLUDING A CURABLE SUPPORT LAYER

(71) Applicant: W. L. Gore & Associates, Inc., Newark, DE (US)

(72) Inventor: Andrew J. Holliday, Newark, DE (US)

(73) Assignee: W. L. Gore & Associates, Inc., Newark, DE (US)

( * ) Notice: Subject to any disclaimer, the term of this patent is extended or adjusted under 35 U.S.C. 154(b) by 0 days.

(21) Appl. No.: 16/646,049

(22) PCT Filed: Sep. 19, 2017

(86) PCT No.: PCT/US2017/052328

§ 371 (c)(1),
(2) Date: Mar. 10, 2020

(87) PCT Pub. No.: WO2019/059896

PCT Pub. Date: Mar. 28, 2019

(65) Prior Publication Data

US 2020/0280781 A1 Sep. 3, 2020

(51) Int. Cl.

| | |
|---|---|
| ***H04R 1/00*** | (2006.01) |
| ***H04R 1/08*** | (2006.01) |
| ***H04R 1/02*** | (2006.01) |

(52) U.S. Cl.
CPC ..... *H04R 1/086* (2013.01); *H04R 1/023* (2013.01)

(58) Field of Classification Search
CPC ... H04R 1/00; H04R 1/02; H04R 1/08; H04R 1/023; H04R 1/086; H04R 1/44; H04R 7/10; H04R 7/16; H04R 7/18; H04R 7/20; H04R 19/00; H04R 19/005; H04R 19/02; H04R 19/04; C08J 7/00; C08J 7/12; B81B 3/00; B81B 3/0035; B81B 2101/0257
See application file for complete search history.

(56) References Cited

U.S. PATENT DOCUMENTS

| | | | | |
|---|---|---|---|---|
| 5,828,012 | A | 10/1998 | Repolle et al. | |
| 6,512,384 | B1 | 1/2003 | Banter et al. | |
| 6,932,187 | B2 * | 8/2005 | Banter | H04R 1/023 181/149 |
| 9,038,773 | B2 * | 5/2015 | Banter | G10K 11/002 181/286 |
| 10,021,800 | B1 * | 7/2018 | Zhang | H05K 5/068 |
| 2017/0006369 | A1 * | 1/2017 | Kenaley | H04R 1/023 |
| 2017/0245036 | A1 * | 8/2017 | Kuki | H04R 1/086 |
| 2019/0268692 | A1 * | 8/2019 | Zero | G01F 1/36 |
| 2020/0329289 | A1 * | 10/2020 | Kenaley | H04R 19/005 |

OTHER PUBLICATIONS

International Search Report and Written Opinion from International Application No. PCT/US2017/052328 dated May 24, 2018.

* cited by examiner

*Primary Examiner* — Thang V Tran
(74) *Attorney, Agent, or Firm* — Greenberg Traurig, LLP

(57) ABSTRACT

A protective cover assembly is disclosed that includes a membrane and a layered assembly bonded to the membrane. The membrane is positioned in an acoustic pathway and has a first side and a second side, the first side facing toward an acoustic cavity and the second side of the membrane facing toward an opening of the acoustic pathway. The layered assembly includes at least one curable support layer bonded to a side of the membrane formed of a polymer adhesive and defining at least a portion of a wall for the acoustic pathway.

19 Claims, 4 Drawing Sheets

ACOUSTIC PROTECTIVE COVER INCLUDING A CURABLE SUPPORT LAYER

RELATED APPLICATIONS

The present application is a national phase filing under 35 USC 371 of International Application No. PCT/US2017/052328 filed on Sep. 19, 2017, the entire contents and disclosures of which are hereby incorporated by reference.

TECHNICAL FIELD

The present disclosure relates generally to acoustic protective covers that include membranes. More specifically, but not by way of limitation, this disclosure relates to a protective cover assembly containing a membrane and a curable support layer.

BACKGROUND

Acoustic cover technology is utilized in many applications and environments, for protecting sensitive components of acoustic devices from environmental conditions. Various components of an acoustic device operate best when not in contact with debris, water, or other contaminants from the external environment. In particular, acoustic transducers (e.g. microphones, speakers) may be sensitive to fouling. For these reasons, it is often necessary to enclose working parts of an acoustic device with an acoustic cover.

Modern electronic devices, including by not limited to radios, televisions, computers, tablets, cameras, toys, unmanned vehicles, cellular telephones and other micro-electro-mechanical systems (MEMS), include internal transducers, e.g., microphones, ringers, speakers, buzzers, sensors, accelerometers, gyroscopes, and the like, that communicate with the external environment through openings. Openings located near these transducers to enable sound to be transmitted or received, but also create an entry point for liquid, debris and particles that may cause damage to the electronic device. Protective cover assemblies have been developed to provide protection for internal electronics, including the transducers, from damage due to the entry of liquids, debris and particles through the openings.

Membranes, such as expanded polytetrafluoroethylene (ePTFE), have also been used as protective covers. A protective cover can transmit sound in two ways: the first is by allowing sound waves to pass through it, known as a resistive protective cover; the second is by vibrating to create sound waves, known as a vibroacoustic, or reactive, protective cover. Increasing the resiliency of a membrane in an acoustic protective assembly against water penetration can decrease the ability of the assembly to properly transmit sound.

Known protective acoustic covers include non-porous films and porous membranes, such as expanded polytetrafluoroethylene (ePTFE). Protective acoustic covers are also described in U.S. Pat. Nos. 6,512,834 and 5,828,012.

Japanese Pub. No. 2015-142282 discloses a waterproof component provided with a waterproof sound-transmittable film. A support layer is adhered to the surface of at least one side of the waterproof sound-transmittable film. The support layer polyolefin-system-resin foam, with a loss modulus of less than $1.0\times10^7$ Pa.

U.S. Pat. No. 6,188,773 discloses a waterproof type microphone, which includes a microphone casing provided with a unit accommodating chamber having a sound receiving opening portion, a microphone unit accommodated in the unit accommodating chamber, and a waterproof membrane air tightly mounted on the sound receiving opening portion.

U.S. Pub. No. 2014/0270273 discloses system and method for controlling and adjusting a low-frequency response of a MEMS microphone. The MEMS microphone includes a membrane and a plurality of air vents. The membrane is configured such that acoustic pressures acting on the membrane cause movement of the membrane.

U.S. Pub. No. 2015/0163572 discloses a speaker or microphone module that includes an acoustic membrane and at least one pressure vent.

A continuing problem that exists is that many acoustic cover membranes prove difficult to install without distorting or damaging the membranes. However, increasing the mechanical resiliency of a membrane in an acoustic protective assembly can decrease the ability of the assembly to properly transmit sound.

BRIEF SUMMARY OF SOME EXAMPLE EMBODIMENTS

According to one embodiment of the present invention, a protective cover assembly for an acoustic device is disclosed. The protective cover assembly includes a membrane in an acoustic pathway having a first side and a second side, the first side facing toward an acoustic cavity and the second side of the membrane facing toward an opening of the acoustic pathway. The membrane is bonded to at least one layered assembly that includes a curable support layer, the layered assembly being bonded to one of the first side or the second side of the membrane along the periphery thereof by the curable support layer. The curable support layer is formed of a polymer adhesive that cures and stiffens when subjected to heat, and the layered assembly defines at least a portion of a wall for the acoustic pathway. The assembly can be used in an acoustic device to protect any suitable sound-sensitive acoustic device such as a micro-electric mechanical (MEMS) microphone, an acoustic sensor, or an acoustic speaker.

According to various embodiments, the protective cover assembly is a thermoset adhesive made up of a phenolic resin, epoxy resin, urea resin, polyurethane resin, melamine resin, or polyester resin. The layered assembly can include an adhesive layer adjacent to the curable support layer, where the curable support layer is stiffer than the adhesive layer. In at least one embodiment, the stiffness of the curable support layer may be defined by a shear stiffness of no less than 8,000 grams force (gf). In some embodiments, the shear stiffness of the curable support layer can be no less than 12,900 grams force (gf), or no less than 13,000 gf. The protective cover assembly can further define at least a portion of a wall for an acoustic cavity, preferably arranged in a ring shape that surrounds the acoustic cavity.

The protective cover assembly can further include an adhesive layer bonded to the curable support layer opposite the membrane, or multiple curable support layers. According to some embodiments, the outer layer of the protective cover assembly can include a second curable support layer bonded to a second side of the membrane along the periphery thereof and an adhesive layer can be added adjacent to the second curable support layer, where the curable support layer is a thermoset polymer. The membrane of the protective cover assembly as described above can be microporous, or can preferably be formed of at least one of a polyester, polyethylene, fluoropolymer, polyurethane, or silicone. In specific embodiments, the membrane can be formed from at least one of: expanded polytetrafluoroethylene (ePTFE); expanded olefins, such as expanded polyethylene or expanded polypropylene; fluoropolymers such as polyvinylidene fluoride ("PVDF"), tetrafluoroethylene-hexafluoropropylene copolymer ("FEP"), or tetrafluoroethylene-(perfluoroalkyl) vinyl ether copolymer ("PFA"); films formed of various polyesters, e.g. polyethylene ("PE"), high density polyethylene ("HDPE"), low-density polyethylene ("LDPE"), polyethylene terephthalate ("PET"), biaxially-oriented polyethylene terephthalate ("BoPET")); polypropylene ("PP"), and biaxially-oriented polypropylene ("BOPP"); silicone materials, e.g. ethylene-propylene-diene-monomer ("EPDM"); and suitable composites of any of the above.

The protective cover assemblies as described above may have an insertion loss peak of not greater than 1 dB at 4 kHz when the assembly is subjected to a compressive force of 10 N. More preferably, the protective cover assemblies may have an insertion loss peak of not greater than 1 dB at 4 kHz when the assembly is subjected to a compressive force of 15 N. Embodiments of the protective cover assembly may also employ a curable support layer that can reversibly deform to a 0.5 mm strain when subjected to a shear force greater than 8.0 kg.

Embodiments of protective cover assemblies as described herein may also resist creep. For example, at least one embodiment of a protective cover assembly can include a support layer that is resistant to creep, such that the curable support layer deforms by less than (or amount equal to) 90 microns, preferably by 23 microns or less, and more preferably by 11 microns or less, when subjected to a shear force of 2.5 kgf for a duration of at least 10 minutes.

BRIEF DESCRIPTION OF THE DRAWINGS

The present invention will be better understood in view of the appended non-limiting figures.

DETAILED DESCRIPTION

Figure 1:
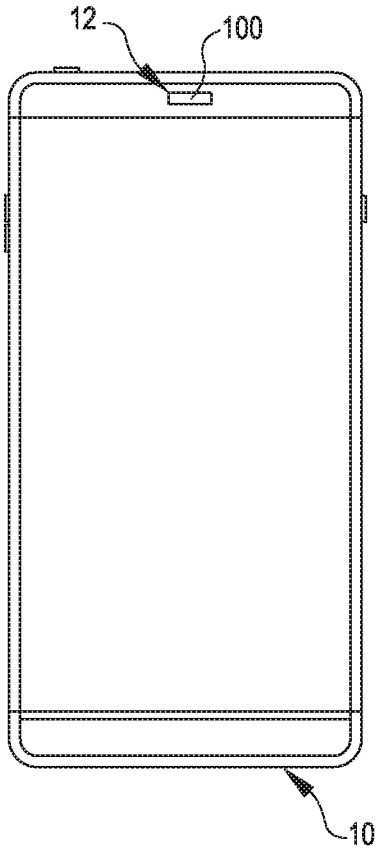
FIG. 1 shows a front view of an electronic device having a protective cover assembly in accordance with the embodiments disclosed herein.

Various embodiments described herein relate to a protective cover assembly for an electronic device that includes a porous membrane with a layered assembly including a curable support layer bonded to the porous membrane. In one embodiment, the curable support layer is a polymer adhesive that defines at least a portion of a wall of an acoustic pathway that passes through the acoustic membrane.

Porous Membranes

The porous expanded membranes described herein may be expanded fluoropolymers, such as expanded polytetrafluoroethylene (ePTFE), or expanded olefins, such as expanded polyethylene or expanded polypropylene. Other fluoropolymers may include polyvinylidene fluoride ("PVDF"), tetrafluoroethylene-hexafluoropropylene copolymer ("FEP"), tetrafluoroethylene-(perfluoroalkyl) vinyl ether copolymer ("PFA"), or the like, may be used because similar to ePTFE these fluoropolymers are hydrophobic, chemical inert, temperature resistance, and have good processing characteristics. Other suitable acoustic materials can include films formed of various polyesters, e.g. polyethylene ("PE"), high density polyethylene ("HDPE"), low-density polyethylene ("LDPE"), polyethylene terephthalate ("PET"), biaxially-oriented polyethylene terephthalate ("BoPET")); polypropylene ("PP"), biaxially-oriented polypropylene ("BOPP"), silicone materials, e.g. ethylene-propylene-diene-monomer ("EPDM"), and suitable composites of any of the above. To provide the necessary protection, the porous expanded membranes should be resistant to moisture and other liquids. In one embodiment, the porous expanded membranes are hydrophobic, but may be hydrophilic by adding a coating or layer. At the same time the porous expanded membranes allow air to pass through without a significant sound attenuation. In one embodiment, ePTFE membranes are described in US Pub. No. 2007/0012624 and U.S. Pub. No. 2013/0183515, the entire contents and disclosure of which is hereby incorporated by reference, may be used.

Along with the lightweight properties, the porous membranes may also be thin. This allows the membranes to be used in electronic devices having a small profile. In one embodiment, the porous membranes have a thickness measured from the first surface to the opposing surface, i.e. second surface, less than or equal to 20 microns, e.g., less than or equal to 10 microns, less than or equal to 5 microns, less than or equal to 2 microns, less than or equal to 1 microns. A thin membrane contributes to good acoustic performance.

In addition to the thinness and lightweight properties, the membranes also have properties that are suitable for transmission of sound while preventing water intrusion. The membrane may have a very open structure that can have a wide range of pore sizes. A nominal pore size of such membranes may be in the range from 0.05 to 5 μm, e.g., from 0.05 to 1 μm. The pore volume may be in the range of 20 to 99 percent, e.g., preferably in the range of 50 to 95 percent. In one embodiment, the membrane may be a microporous membrane that is a continuous sheet of material that is at least 50% porous (i.e., having a pore volume 50%) with 50% or more of the pores being no more than 5 μm in nominal diameter. The air permeability may be in the range from 0.15 to 50 Gurley-seconds, e.g., from 1 to 10 Gurley-seconds. The water entry pressure resistance may be in the range from 5 to 200 psi, e.g., from 20 to 150 psi. Long-term water entry pressure of these membranes may have a duration of greater than 0.5 hours at 1 meter of water pressure, e.g., greater than 4 hours at 1 meter of water pressure.

Curable Support Layers

In accordance with at least one embodiment, acoustic protective covers include a curable support layer bonded to one side of the porous membrane. In some embodiments, two curable support layers may be bonded to opposite sides of the porous membrane. The curable support layer(s) can be a curable polymer layer or curable polymer adhesive, e.g. a thermoset polymer, capable of being bonded to the membrane as a curable support layer precursor prior to a heat treatment step that cures the layer into a cured support layer capable of holding its shape under stress. The curable support layer is cured at a temperature of up to 200° C., which is below the melt point of the membrane. In specific embodiments, the curable support layer is cured at temperatures of up to 170° C., or up to 130° C., or up to 110° C. Once cured, the curable support layer can support a bonded membrane against deformation in both compression and in shear.

Suitable curable support layers include, but are not limited to, polymer adhesives, and specifically thermoset adhesives. Suitable curable adhesives can include the following classes of adhesives, e.g., nitrile phoenolic, epoxy, polymeric, acrylic, silicone, polyurethane, or combinations such as acrylic/silicone/epoxy. Some specific curable polymers include: Nitrile Phoenolic Adhesive 583 supplied by 3M, Inc., Epoxy Adhesive 3232 supplied by Rogers Corporation, Inc., Epoxy Adhesive RFA 7001 supplied by HB Fuller, Inc., Polymeric Adhesive RFA 1005 supplied by HB Fuller, Inc., Adhesive TS8905 supplied by Avery Dennison, Inc., Acrylic/Silicon/Epoxy Adhesive LC2824 supplied by Lintec, Inc., Polyurethane Adhesive EM9002 supplied by HB Fuller, Inc., Adhesive 7970-39 supplied by Adhesives Research Inc., and Nitrile Phenolic Adhesives 58480, 58471, and 58470 supplied by Tesa, Inc.

Acoustic Protective Cover Assembly

In accordance with at least one embodiment, acoustic protective covers include an assembly of any suitable membrane and curable support layer. The membrane of the protective cover assembly permits sound energy to pass through with minimal attenuation, while the curable support layer (or layers) of the protective cover assembly prevents deformation of the membrane during installation of the protective cover assembly or when the protective cover assembly is placed under compression or shear within a device. The protective cover assembly can include various specific layering arrangements of one or more curable support layers and/or additional adhesive layers for securing the protective cover assembly to a device. Prior to installation, the protective cover assembly can be prepared with removable films for preserving the adhesive and protecting the membrane.

In particular, embodiments of acoustic protective cover assemblies as described herein are capable of passing sound energy with minimal attenuation while being capable of withstanding at least 10 N of linear compression, preferably at least 15 N of linear compression, over a 1.6×3.3 mm adhesive area. The relative stiffness of the curable support layer (or layers, in a 2-layer assembly) supports the membrane, preventing the tension in the membrane from changing as the acoustic protective cover assembly is installed and subjected to compressive force. Embodiments of acoustic protective cover assemblies as described herein are also generally resistant to shear stresses for the same reason that they withstand compressive stress, both exhibiting increased shear stiffness over a conventional membrane without cured adhesive and increased resistance to creep when subjected to a constant shear stress.

FIG. 1 shows an external front view of an electronic device 10, which is represented as a cellular phone, having a small opening 12. The opening may be a narrow slot or a circular aperture. Although one opening 12 is shown, it should be appreciated that the number, size and shape of openings in the electronic device 10 may vary. In one embodiment, the maximum diameter of the opening 12 is from 0.1 mm to 500 mm, e.g., from 0.3 mm to 25 mm, or from 0.5 mm to 13 mm. The protective cover assembly 100 is shown covering the opening 12 to prevent intrusion of moisture, debris or other particles into the electronic device 10. The protective assembly cover 100 is suitable for any size of opening and is not particularly limited. Structures disclosed herein may apply equally to openings for sound passage in the protective covers of any comparable electronic device, such as laptop computers, tablets, cameras, portable microphones, or the like. To allow the protective cover assembly 100 to be mounted the size of the protective cover assembly is greater than maximum diameter of the opening 12.

Figure 2:
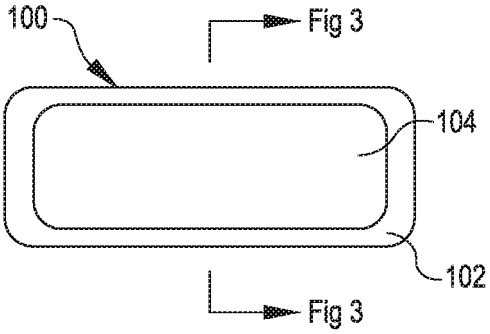
FIG. 2 shows a top view of the protective cover assembly from FIG. 1 in accordance with the embodiments disclosed herein.

Protective cover assembly 100 is shown in more detail in FIG. 2. As shown, the protective cover assembly 100 includes an active area 104 surrounded by a supported area 102. The active area 104 includes the membrane only, and allows sound to pass readily therethrough. The supported area 102 includes the membrane sandwiched between external adhesive layers for connecting the protective cover assembly 100 with the electronic device 10, and at least one curable support layer bonded to the membrane between the membrane and an adhesive layer for providing mechanical support to the assembly.

Figure 3:
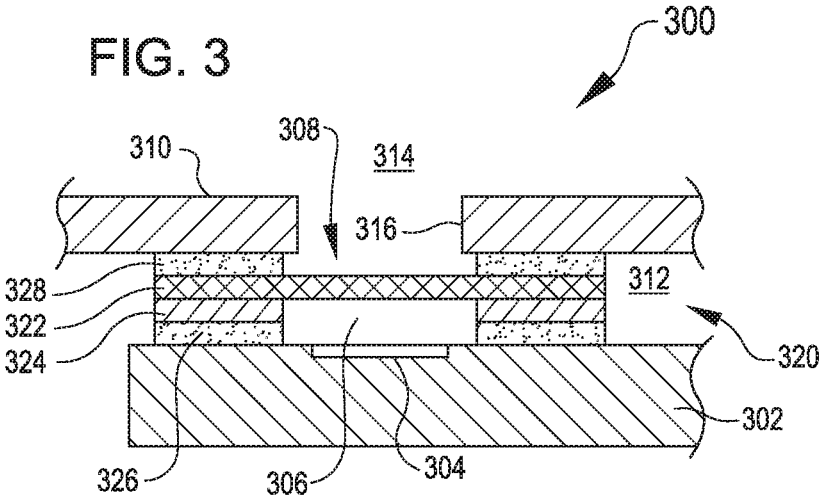
FIG. 3 shows a cross-sectional view of the protective cover assembly in FIGS. 1-2 taken along line A-A as assembled in the electronic device of FIG. 1.

FIG. 3 shows a cross-sectional view of an example assembly 300 of a protective cover assembly 100 that includes a layered assembly 320 inserted in a casing 310 of the electronic device 10. The opening 316 in the casing 310 corresponds to opening 12 (FIG. 1) and defines an acoustic pathway 308, across which the protective cover assembly 100 is placed, separating an exterior environment 314 from an interior environment 312 of the casing 310, and separating exterior environment 314 from an acoustic cavity 306. The casing 310 is arranged around and configured to protect electronics 302, e.g. a circuit board or the like for a mobile device, mobile phone, tablet, etc., with the layered assembly 320 placed to prevent water or debris entry into the interior environment 312 and particularly to protect a transducer 304. The transducer 304 is positioned beneath the active area 104 within the opening 12 for generating or receiving sound The layered assembly 320 includes a membrane 322, curable support layer 324, and two external adhesive layers 326, 328. In one embodiment, the layered assembly 320 is assembled with a single support layer 324 bonded directly to the membrane 322, with external adhesives 326, 328 bonded, respectively, to the curable support layer and to the membrane. The external adhesives 326, 328 connect the layered assembly 320 with the internal electronics 302 and the casing 310 while preventing water intrusion into the internal environment 312 from the external environment 314. Generally, the number of layers and concurrent thickness of the layered assembly 320 will be minimized in order to miniaturize the electronic device in which the acoustic protective cover assembly is placed; however, depending on the topology of the internal electronics 302 and the size of the casing 310, additional layers may be provided, such as gasket layers or the like, between the external adhesives 326, 328 and either or both of the internal circuitry and casing. The external adhesives 326, 328 are generally not water permeable, and may additionally be hydrophobic.

Acoustic waves may be passed through the acoustic cavity 306 and through the membrane 322 between the transducer 304 and the external environment 314 along the acoustic pathway 308. The acoustic pathway 308 is generally defined by the opening 316 in the casing 310. This opening 316 is generally approximately the same size as an unobstructed portion of the membrane 322; however, the curable support layer 324 and external adhesive layers 326, 328 may define internal voids that are larger than the opening 316.

The acoustic pathway 308 may also provide venting. Venting can provide for pressure equalization between the acoustic cavity 306 and the external environment 314. Venting is useful when pressure differences arise between the acoustic cavity 306 and external environment 314 that affect the ability of the layered assembly 320 to pass acoustic waves. For example, a temperature change in the acoustic cavity 306 may cause an expansion or contraction of air within the acoustic cavity, which would tend to deform the layered assembly 320 and cause acoustic distortion. By providing a porous or microporous material for the membrane 322, the layered assembly 320 can be made capable of passing air therethrough in order to equalize pressure. The equilibration rate of the protective cover assembly may be sufficiently high to allow air to enter or leave the acoustic cavity via venting to substantially prevent or mitigate such distortion. Notably, this breathability is correlated with thinner membranes that may be prone to deformation or damage during installation or use. By providing a curable support layer 324 bonded to the membrane 322, the layered assembly 320 can significantly reduce instances of tearing, delamination, or deformation of the membrane during installation or use.

In one embodiment, the total thickness of the layered assembly 320 may be from 50 μm to 1000 μm, e.g., from 120 μm to 300 μm. Without being limiting, in some exemplary applications, a protective cover assembly may be used in combination with a MEMS transducer having comparably small thickness, e.g., on the order of 100 μm to 1000 μm. Thus, an electronic device incorporating the protective cover assembly 100 may be very thin such as from 0.2 to 1.2 mm, which is suitable for inclusion in many small form factor applications, such as handheld electronic devices.

Figure 4:
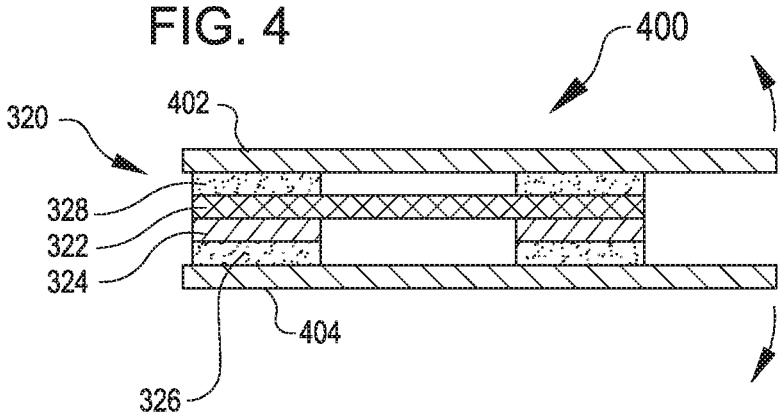
FIG. 4 is a side section view of a first example of a protective cover assembly in conjunction with removable layers, in accordance with the embodiments disclosed herein.
Figure 5:
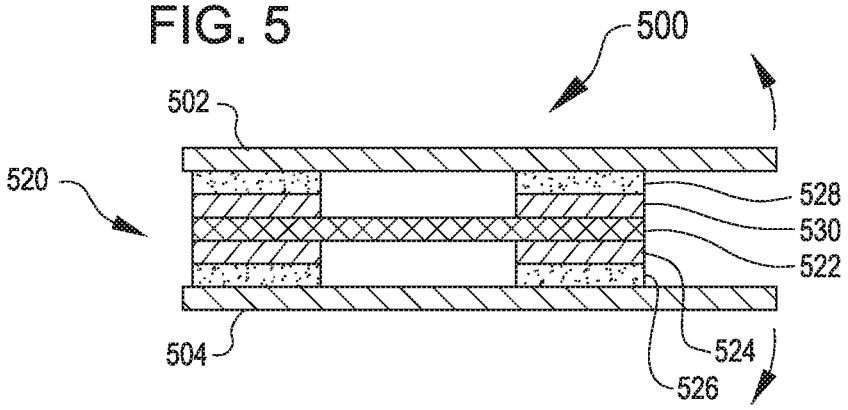
FIG. 5 is a side section view of a second example of a protective cover assembly in conjunction with removable layers, in accordance with the embodiments disclosed herein.

Further examples of protective cover assemblies in conjunction with removable protective layers are shown in FIGS. 4-5 prior to installation in an electronic device. For example, FIG. 4 shows an assembly 400 of the layered assembly 320 (FIG. 3) between two release liners 402, 404. In practice, the layered assembly 320 can be assembled with an electronic device (e.g. device 10, FIG. 1), by removing a first release liner 404 and emplacing the protective cover assembly therein; and then by removing the second release liner 402 prior to enclosing the protective cover assembly in the electronic device. In general, the layered assembly 320 will be assembled with an electronic device with the curable support layer 324 positioned "down," i.e. facing the transducer of the electronic device and forming a portion of a wall of the acoustic cavity (e.g. acoustic cavity 306, FIG. 3). However, in some alternative embodiments, the curable support layer may face in the opposite direction.

FIG. 5 shows a similar assembly 500 of a protective cover assembly 520 in conjunction with removable protective layers, in accordance with at least one embodiment. The protective cover assembly 520 includes a membrane 522 and two curable support layers 524, 530 bonded to opposing sides of the membrane. External adhesive layers 526, 528 are bonded to the curable support layers 524, 530 also on opposite sides of the membrane 522, and between the release liners 504, 502. In use, the protective cover assembly 520 can be assembled with an electronic device (e.g. electronic device 10, FIG. 1) in the same manner as layered assembly 320 (FIGS. 3-4).

Methods and Examples

Sample Preparation for Stiffness and Creep Testing

Stiffness testing was performed by adhering each sample to two test plates. For connecting the samples with the first test plate, a 0.016-in thick aluminum plate was heated on a hot plate. The hot plate setting varied from room temperature to about 200° C., depending on the processing recommendations of the adhesive datasheets. For example, the hot plate was set to approximately 100° C. for bonding the Flexel™ EM9002 adhesive, provided by H.B. Fuller, Inc. A one square inch sample of adhesive was tacked down to the aluminum plate with a hand roller, while on hot plate. A release liner, which is provided with the adhesives, was then removed and a matching aluminum plate was tacked to the opposite side of the adhesive with a hand roller.

Once the aluminum plates were tacked together by the adhesive, the assembly was placed into an oven. Again, time and temperatures for the curing process were adjusted based on the recommendations provided on the datasheets. For example, for the Flexel™ EM9002 sample, the oven was set to 110° C., and the sample was cured in the oven for at least 1.5 minutes.

Creep Resistance Test

Creep resistance was measured using a Stable Micro Systems, Inc., TA.XT plus Texture Analyzer. A constant shear stress of 2.5 kgf was applied while the strain was recorded over a period of 10 minutes. The average measured strain over the final 100 s of the test was used to compare the creep performance of the adhesives.

Shear Stiffness Test

Shear stiffness was measured using a Stable Micro Systems, Inc., TA.XT plus Texture Analyzer. The sample was strained at a rate of 0.01 mm/s while the resulting shear force was measured. To compare samples, the force generated by a 0.5 mm strain was recorded.

Change in Insertion Loss Due to Compression Test:

Circular acoustic covers were formed out of each test adhesive type (See Table 1), each having an inner diameter (ID) of 1.6 mm and an outer diameter of 3.3 mm. 'One layer' constructions were supported on one side by an adhesive ring of pressure sensitive adhesive (PSA) (all PSA layers were Nitto Denko 5065R), and on the other side with a ring composed of the test adhesive laminated together with PSA. The test adhesive was mounted adjacent to the acoustic membrane. The acoustic membrane used for all samples was a microporous ePTFE membrane, available from W.L. Gore & Associates, Inc., having appropriate protective, acoustic, and structural properties, e.g., microporous ePTFE having a thickness on the order of 1-20 μm and an acoustic transmission loss of less than 1.5 dB at 1 kHz. 'Two layer' constructions were supported on both sides by adhesive rings composed of the test adhesive laminated together with PSA, with the test adhesive adjacent to the acoustic membrane. The externally facing PSA layers were designed to allow the samples to be mounted temporarily to the test fixture at room temperature. For comparison, samples were created which were supported by PSA adhesive rings on both sides of the membrane.

To create samples with test adhesives, the ID feature was first cut through the layer of test adhesive laminated to PSA. The acoustic membrane was then laminated to the test adhesive using a heated press, in order to tack the test adhesive to the acoustic membrane. An ID feature was then cut through a second layer of adhesive. For '1-layer' construction, the second layer of adhesive was a PSA. For '2-layer' constructions, that second layer of adhesive was composed of the same test adhesive and a PSA, and an additional heated pressing step was performed in order to tack the second layer of test adhesive to the acoustic membrane.

The sample was mounted to a first fixture plate with an aperture size of 1.3 mm. The first fixture plate was them mounted to a second sample plate so that the sample was bonded between the fixture plates. The second fixture plate had a 0.9 mm aperture aligned with the first aperture and the center of the sample. Behind the second aperture, a Knowles® SPA2410LF5H measurement microphone (Knowles Electronics, LLC. Itasca, Ill., USA) was assembled by way of soldering. Additional fixtures, including a spring, provided a compression force by pulling the first fixture plate towards the second fixture plate. A thumbs screw and a FC22 force sensor, available from TE Connectivity Corporation, allowed for control over the force between the two fixture plates, which act on the sample.

The fixture assembly was placed inside a B&K type 4232 anechoic test box (Brüel & Kjaer, Nærum, Denmark) at a distance of 6.5 cm from an internal driver or speaker. That distance was maintained by mounting the fixture to a base plate with locking pins. The speaker was excited to produce an external stimulus at 0.5 Pa of sound pressure (88 dB SPL) over the frequency range from 100 Hz to 11.8 kHz. The measurement microphone measured the acoustic response as a sound pressure level in dB over the frequency range. For calibrating the test, measurements were obtained with samples of adhesive rings, without any acoustic membrane present.

Upon initial installation, the force was set using the thumb screw to 5 N for 15 seconds to ensure that the PSA layers would completely seal against both fixture plates. After 15 seconds, the force was reduced to 2 N. To allow any movement of the adhesive to settle, there was 1 minute delay between setting the compression force, and initializing the speaker excitation. The same sample was then tested with a 5 N, 10 N, and 15 N compression setting.

Various protective cover assemblies were prepared and tested as described above. The specific materials, their parameters, and their performance characteristics are summarized below as set out in Tables 1 and 2, and in accordance with the following description. 1-layer construction refers to assemblies as shown in FIGS. 3-4; and 2-layer construction refers to assemblies as shown in FIG. 5, above. The methods used to form each of the samples are described below.

TABLE 1

Example Parameters

| Example | Supplier | Adhesive | Composition | Construction |
|---|---|---|---|---|
| Comparative | Nitto Denko, Inc. | 5605R | Acrylic PSA | 2 Layer |
| Example 1 | 3M, Inc. | 583 | Nitrile Phenolic | 2 Layer |
| Example 2 | 3M, Inc. | 583 | Nitrile Phenolic | 1 Layer |
| Example 3 | Rogers Corp. | 3232 | Epoxy | 2 Layer |
| Example 4 | Rogers, Corp. | 3232 | Epoxy | 1 Layer |
| Example 5 | HB Fuller, Inc. | RFA 7001 | Epoxy | 2 Layer |
| Example 6 | HB Fuller, Inc. | RFA 7001 | Epoxy | 1 Layer |
| Example 7 | HB Fuller, Inc. | RFA 1005 | Polymeric | 2 Layer |
| Example 8 | HB Fuller, Inc. | RFA 1005 | Polymeric | 1 Layer |
| Example 9 | Avery Dennison, Inc. | TS8905 | Polymer Composite | 2 Layer |
| Example 10 | Lintec, Inc. | LC2850 | Acrylic/ Silicone/Epoxy | 2 Layer |
| Example 11 | Lintec, Inc. | LC2850 | Acrylic/ Silicone/Epoxy | 1 Layer |
| Example 12 | Lintec, Inc. | LC2824 | Acrylic/ Silicone/Epoxy | 2 Layer |
| Example 13 | Lintec, Inc. | LC2824 | Acrylic/ Silicone/Epoxy | 1 Layer |
| Example 14 | HB Fuller, Inc. | EM9002 | Polyurethane | 2 Layer |
| Example 15 | HB Fuller, Inc. | EM9002 | Polyurethane | 1 Layer |
| Example 16 | Adhesives Research, Inc. | 7970-39 | Thermoset Adhesive | 1 Layer |
| Example 17 | Tesa, Inc. | 58480 | Nitrile Phenolic | 2 Layer |
| Example 18 | Tesa, Inc. | 58480 | Nitrile Phenolic | 1 Layer |
| Example 19 | Tesa, Inc. | 58471 | Nitrile Phenolic | 2 Layer |
| Example 20 | Tesa, Inc. | 58471 | Nitrile Phenolic | 1 Layer |
| Example 21 | Tesa, Inc. | 58470 | Nitrile Phenolic | 2 Layer |
| Example 22 | Tesa, Inc. | 58470 | Nitrile Phenolic | 1 Layer |

TABLE 2

Example Performance

| Example | Creep Resistance at 2.5 kgf (mm) (500-600 s) | Shear Stiffness at 0.5 mm strain | Avg. Insertion Loss at 4 kHz and 2N compression (dB) | Avg. Insertion Loss at 4 kHz and 15N compression (dB) | Change in Insertion Loss due to Compression (dB) |
|---|---|---|---|---|---|
| C. | 0.150 | 7,000 | 86.04 | 79.68 | 6.36 |
| 1 | 0.007 | 13,518 | 86.24 | 86.59 | −0.35 |
| 2 | 0.007 | 13,518 | 86.53 | 86.36 | 0.17 |
| 3 | 0.005 | 14,201 | 85.94 | 85.61 | 0.34 |
| 4 | 0.005 | 14,201 | 85.65 | 85.99 | −0.34 |

TABLE 2-continued

| Example Performance | | | | | |
|---|---|---|---|---|---|
| Example | Creep Resistance at 2.5 kgf (mm) (500-600 s) | Shear Stiffness at 0.5 mm strain | Avg. Insertion Loss at 4 kHz and 2N compression (dB) | Avg. Insertion Loss at 4 kHz and 15N compression (dB) | Change in Insertion Loss due to Compression (dB) |
| 5 | 0.005 | 13,920 | 85.10 | 82.05 | 3.05 |
| 6 | 0.005 | 13,920 | 86.98 | 83.01 | 3.97 |
| 7 | 0.010 | 13,388 | 85.87 | 86.56 | −0.69 |
| 8 | 0.010 | 13,388 | 86.46 | 86.78 | −0.33 |
| 9 | 0.090 | 8,000 | 87.03 | 80.96 | 6.08 |
| 10 | 0.004 | 13,967 | 86.66 | 86.30 | 0.37 |
| 11 | 0.004 | 13,967 | 85.97 | 86.77 | −0.81 |
| 12 | 0.010 | 13,522 | 85.95 | 86.62 | −0.68 |
| 13 | 0.010 | 13,522 | 85.10 | 86.31 | −1.21 |
| 14 | 0.010 | 12,982 | 86.13 | 86.67 | −0.54 |
| 15 | 0.010 | 12,982 | 86.13 | 86.44 | −.032 |
| 16 | 0.010 | 13,426 | 84.76 | 82.04 | 2.73 |
| 17 | 0.009 | 12,929 | 86.14 | 87.44 | −1.30 |
| 18 | 0.009 | 12,929 | 86.89 | 87.36 | −0.47 |
| 19 | 0.011 | 13,858 | 85.77 | 86.13 | −0.35 |
| 20 | 0.011 | 13,858 | 86.44 | 86.25 | 0.20 |
| 21 | 0.022 | 12,928 | 86.65 | 86.17 | 0.48 |
| 22 | 0.022 | 12,928 | 86.64 | 86.39 | 0.25 |

Figure 6:
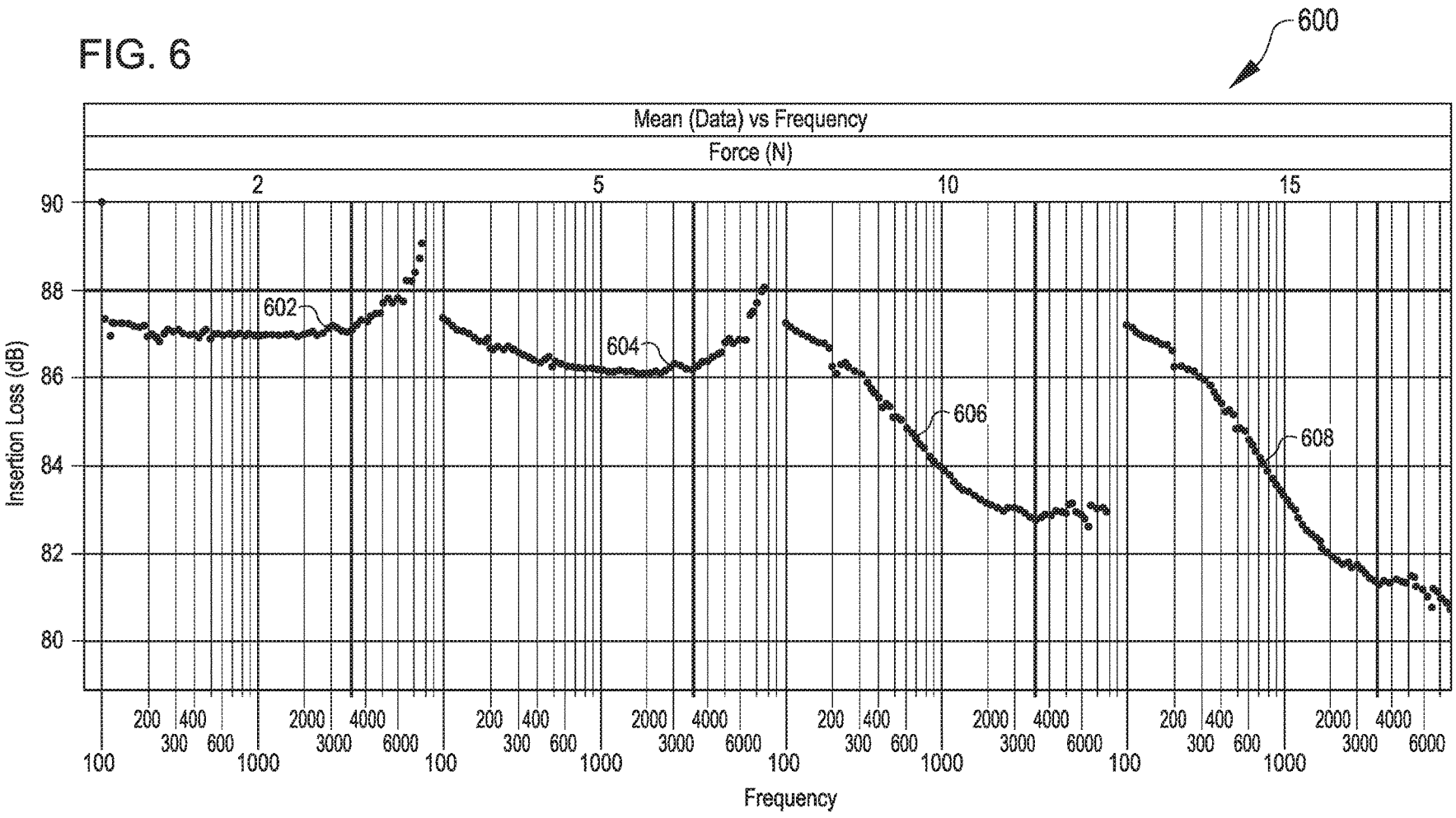
FIG. 6 is a chart graphically illustrating insertion loss (i.e. difference in sound pressure level compared to an unobstructed microphone) for embodiments of an acoustic protective cover under varying compressive force.

Experimental Results:

Samples were tested for compression-induced acoustic losses based on a calibrated starting sound pressure of 88 dB, and tested over a range of frequencies and compression states. In general, the impact of compression was seen most at higher frequencies (see Example 9, referring to Avery Dennison TS8905, a composite adhesive available from Avery Dennison, Inc.). In order to compare performance between samples, the insertion loss at 4 kHz was recorded. For purposes of avoiding distortion, it is important both that overall acoustic losses are minimized, and that acoustic losses are consistent over the range of pressures. Therefore, the change in insertion loss due to compression was calculated as the difference in 4 kHz insertion loss at 2 N and 15 N compression levels. For illustrative purposes, FIG. 6 is a chart 600 graphically illustrating insertion loss at various force levels and across the frequency band for this Example 9, with distinct curves showing change in insertion loss at compression of 2 N (602), 5 N (604), 10 N (606) and 15 N (608).

Figure 7:
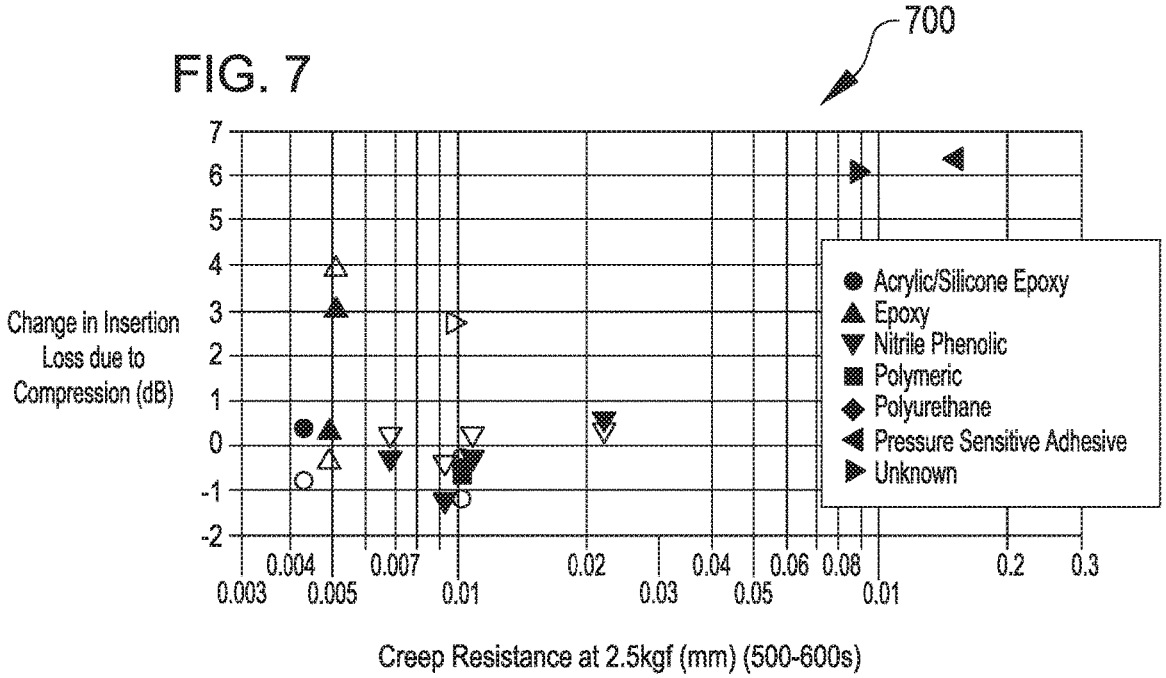
FIG. 7 is a chart graphically illustrating the insertion losses and creep resistance of the curable layers for various embodiments of acoustic protective covers under a shearing load.
Figure 8:
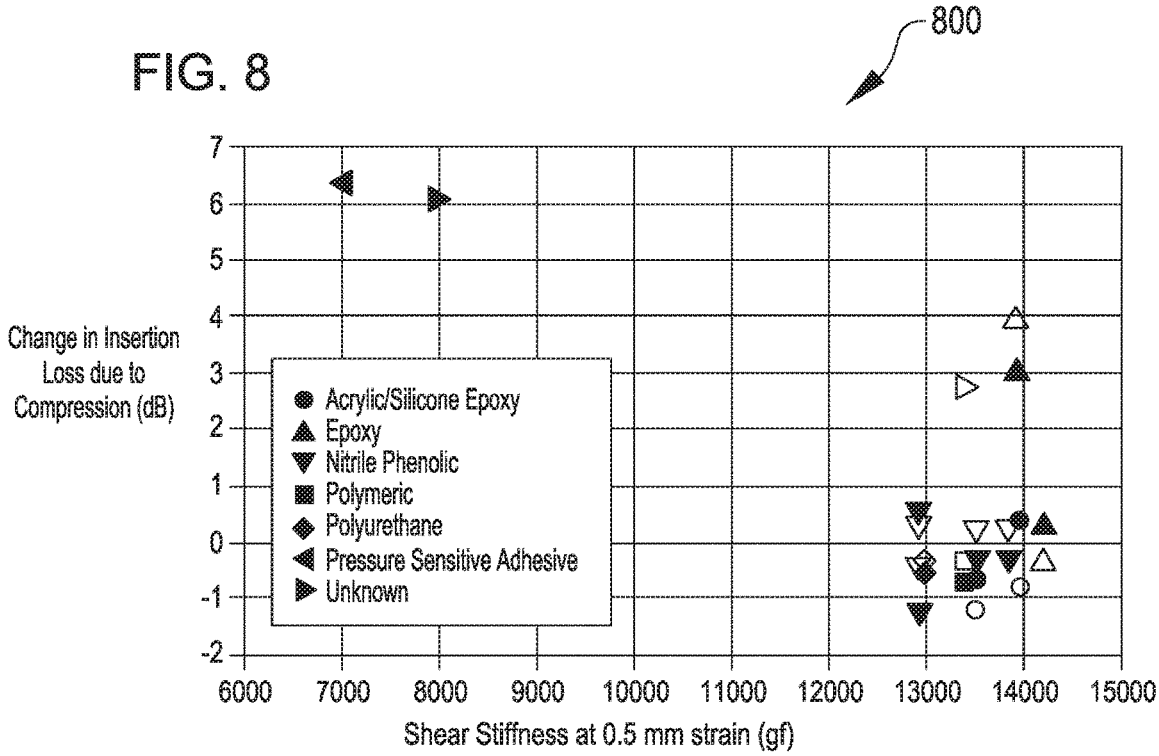
FIG. 8 is a chart graphically illustrating the insertion losses and shear stiffness for various embodiments of the curable layers for acoustic protective covers under a shearing load.

In general, performance of 1-layer and 2-layer constructions were similar in terms of creep resistance and shear stiffness (FIGS. 7-8). As shown, most tested materials displayed only small changes in insertion loss (i.e. insertion loss peak) due to compression under both 10 N compressive force at 4 kHz, typically by less than 1 dB. Most tested materials also displayed less than 1 dB change in insertion loss at 4 kHz due to compression under 15 N compressive force. Furthermore, almost all tested materials displayed creep resistance of less than 0.03 mm creep from 500-600 s at a constant imposed shear force of 2.5 kgf. (FIG. 7), even while exhibiting less than 1 dB of change in insertion loss between 2 N and 15 N compressive force. These materials also exhibited high shear stiffness when subjected to a shear strain of 0.5 mm, with values on the order of about 13,000 gf at 0.5 mm strain and higher (FIG. 8). 1-layer constructions exhibit the advantages of ease of processing, ease of attaching to membranes with low surface energy, and lower cost; while 2-layer constructions generally attain better technical results in terms compression and shear resistance.

Acoustic Cover Samples:

COMPARATIVE EXAMPLE

A 1.6 mm hole with cut through a layer of 5605R adhesive, available from Nitto Denko, using a standard CO2 laser. One of the release liners, provided with the adhesive, was removed, and a layer of ePTFE membrane was laminated at room temperature to the exposed adhesive with a hand roller. The second release liner was then removed, and a 6.5 mm, silicone release coated PET liner, provided by Flexconn, Inc., was put in its place. Another 1.6 mm hole was cut in a second layer of 5605R adhesive, using a $CO_2$ laser. One of the release liners, provided with the adhesive, was removed and the adhesive was laminated at room temperature to the second side of the membrane so that the two 1.6 mm holes were aligned. Finally, with a $CO_2$ laser, a 3.3 mm circle was cut through all of the layers, other than the 6.5 mm silicone release liner, in order to create the outer dimension of the acoustic cover.

Example 1

A 2 layer acoustic curable adhesive sample was produced with the following method: A layer of 583 Thermal Bonding Film for use as the curable support layer, available from 3M, Inc., was laminated to a layer of 5605R adhesive as the external adhesive layer, available from Nitto Denko, Inc., at room temperature with a hand roller. A 1.6 mm hole was cut through the laminate with a $CO_2$ laser. The release liner provided with the 583 film was then removed, and a layer of ePTFE membrane as described above was laminated to the 583 curable adhesive layer using a Geo Knight 394 Shuttle press, available from Geo Knight & Co, Inc., set to 40 psi and 100° C. for 10 s. A second 1.6 mm hole was cut through the same laminate with a $CO_2$ laser. The release liner provided with the 583 film was removed, and the film was laminated to the second side of the membrane so that the two 1.6 mm holes were aligned, using the same shuttle press at the same settings. Finally, with a $CO_2$ laser, a 3.3 mm circle was cut through all of the layers, other than the 6.5 mm silicone release liner, in order to create the outer dimension of the acoustic cover, with one of the release liners provided with the 5605R adhesive as the top layer. To cure the 583 adhesive, the layered assembly was then placed between two layers of pressure/temperature equalization pads, available from Insulectro, Inc., which were then placed between two aluminum plates. The layered assembly was then placed in an oven at 170° C. for about 2 h to allow the plates to come to temperature and for the adhesive to cure.

Example 2

A 1 layer acoustic adhesive sample was produced with the following method: A layer of 583 Thermal Bonding Film for use as the curable adhesive layer, available from 3M, Inc., was laminated to a layer of 5605R adhesive for use as the external adhesive, available from Nitto Denko, at room temperature with a hand roller. A 1.6 mm hole was cut through the laminate with a CO2 laser. The release liner provided with the 583 film was then removed, and the ePTFE membrane as provided for Example 1 was laminated to the curable adhesive layer using a Geo Knight 394 Shuttle press set to 40 psi and 100° C. for 10 s. A second 1.6 mm hole was cut through a layer of 5605R adhesive. The release liner provided with the external adhesive layer was removed, and the film was laminated to the second side of the membrane so that the two 1.6 mm holes were aligned, using the shuttle press at the same settings. Finally, with a CO2 laser, a 3.3 mm circle was cut through all of the layers, other than the 6.5 mm silicone release liner, in order to create the outer dimension of the acoustic cover, with one of the release liners provided with the 5605R adhesive as the top layer. To cure the 583 adhesive, the layered assembly was then placed between two layers of pressure/temperature equalization pads, available from Insulectro, Inc., which were then placed between two aluminum plates. The layered assembly was placed in an oven at 170° C. for about 2 h to allow the plates to come to temperature, and for the adhesive to cure.

Example 3

A 2 layer acoustic adhesive sample was produced in accordance with example 1, with the exception that the thermoset film was RXP 3232 Bondply, available from Rogers Corporation, and the curing process was performed at 150° C.

Example 4

A 1 layer acoustic adhesive sample was produced in accordance with example 2, with the exception that the thermoset film was RXP 3232 Bondply, available from Rogers Corporation, and the curing process was performed at 150° C.

Example 5

A 2 layer acoustic adhesive sample was produced in accordance with example 1, with the exception that the thermoset film was Flexel™ RFA7001, available from H.B. Fuller, and the curing process was performed at 110° C.

Example 6

A 1 layer acoustic adhesive sample was produced in accordance with example 2, with the exception that the thermoset film was Flexel™ RFA7001, available from H.B. Fuller, and the curing process was performed at 110° C.

Example 7

A 2 layer acoustic adhesive sample was produced in accordance with example 1, with the exception that the thermoset film was Flexel™ RFA1005, available from H.B. Fuller, and the curing process was performed at 110° C.

Example 8

A 1 layer acoustic adhesive sample was produced in accordance with example 2, with the exception that the thermoset film was Flexel™ RFA1005, available from H.B. Fuller, and the curing process was performed at 110° C.

Example 9

A 2 layer acoustic adhesive sample was produced in accordance with example 1, with the exception that the thermoset film TS8905, available from Avery Dennison, and the curing process was performed at 110° C. Also, the adhesive was not laminated to the 5605R adhesive, because the TS8905 is still moderately tacky at room temperature, even after the curing step.

Example 10

A 2 layer acoustic adhesive sample was produced in accordance with example 1, with the exception that the thermoset film was Adwill LC2850(25), available from Lintec Corporation, and the curing process was performed at 130° C.

Example 11

A 1 layer acoustic adhesive sample was produced in accordance with example 2, with the exception that the thermoset film was Adwill LC2850(25), available from Lintec Corporation, and the curing process was performed at 130° C.

Example 12

A 2 layer acoustic adhesive sample was produced in accordance with example 1, with the exception that the thermoset film was Adwill LC2824H(25), available from Lintec Corporation, and the curing process was performed at 130° C.

Example 13

A 1 layer acoustic adhesive sample was produced in accordance with example 2, with the exception that the thermoset film was Adwill LC2824H(25), available from Lintec Corporation, and the curing process was performed at 130° C.

Example 14

A 2 layer acoustic adhesive sample was produced in accordance with example 1, with the exception that the thermoset film was Flexel™ EM9002, available from H.B. Fuller, and the curing process was performed at 110° C.

Example 15

A 1 layer acoustic adhesive sample was produced in accordance with example 2, with the exception that the thermoset film was Flexel™ EM9002, available from H.B. Fuller, and the curing process was performed at 110° C.

Example 16

A 2 layer acoustic adhesive sample was produced in accordance with example 1, with the exception that the thermoset film was ARclad® IS-7970-39, available from Adhesives Research, and the curing process was performed at 160° C.

Example 17

A 2 layer acoustic adhesive sample was produced in accordance with example 1, with the exception that the thermoset film was HAF 58480, available from Tesa®, and the curing process was performed at 100° C.

Example 18

A 1 layer acoustic adhesive sample was produced in accordance with example 2, with the exception that the thermoset film was HAF 58480, available from Tesa®, and the curing process was performed at 100° C.

Example 19

A 2 layer acoustic adhesive sample was produced in accordance with example 1, with the exception that the thermoset film was HAF 58471, available from Tesa®, and the curing process was performed at 200° C.

Example 20

A 1 layer acoustic adhesive sample was produced in accordance with example 2, with the exception that the thermoset film was HAF 58471, available from Tesa®, and the curing process was performed at 200° C.

Example 21

A 2 layer acoustic adhesive sample was produced in accordance with example 1, with the exception that the thermoset film was HAF 58470, available from Tesa®, and the curing process was performed at 200° C.

Example 22

A 1 layer acoustic adhesive sample was produced in accordance with example 2, with the exception that the thermoset film was HAF 58470, available from Tesa®, and the curing process was performed at 200° C.

The invention has now been described in detail for the purposes of clarity and understanding. However, those skilled in the art will appreciate that certain changes and modifications may be practiced within the scope of the appended claims.

In the preceding description, for the purposes of explanation, numerous details have been set forth in order to provide an understanding of various embodiments of the present invention. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present invention. Accordingly, the above description should not be taken as limiting the scope of the present invention or claims.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the present invention, subject to any specifically excluded limit in the stated range. Where the stated range includes one or both of the limits, ranges excluding either or both of those included limits are also included.

As used herein and in the appended claims, the singular forms "a", "an", and "the" include plural references unless the context clearly dictates otherwise. Also, the words "comprise," "comprising," "contains," "containing," "include," "including," and "includes," when used in this specification and in the following claims, are intended to specify the presence of stated features, integers, components, or steps, but they do not preclude the presence or addition of one or more other features, integers, components, steps, acts, or groups.

What is claimed is:

1. An assembly comprising:

a membrane in an acoustic pathway, wherein the membrane comprises:

a first side, wherein the first side faces toward an acoustic cavity; and a second side, wherein the second side of the membrane faces toward an opening of the acoustic pathway; and at least one layered assembly, wherein the at least one layered assembly is bonded to one of the first side of the membrane or the second side of the membrane along a periphery of the first side of the membrane or the second side of the membrane, wherein the at least one layered assembly comprises:

a curable support layer; and a first external adhesive, wherein the first external adhesive is bonded to the curable support layer; and a second external adhesive, wherein the second external adhesive is bonded to the membrane;

wherein the at least one layered assembly defines at least a portion of a wall for the acoustic pathway, and wherein the curable support layer having has a shear stiffness of at least 8,000 gf at a strain of 0.5 mm.

2. The assembly of claim 1, wherein the curable support layer is a thermoset adhesive comprising a phenolic resin, epoxy resin, urea resin, polyurethane resin, melamine resin, or polyester resin.

3. The assembly of claim 1, wherein the curable support layer is stiffer than the first external adhesive layer.

4. The assembly of claim 1, wherein the curable support layer has a stiffness of 8,000 gf to 13,000 gf, at a strain of 0.5 mm.

5. The assembly of claim 1, wherein the at least one layered assembly defines at least a portion of a wall for the acoustic cavity.

6. The assembly of claim 1, wherein the curable support layer is bonded to the first side of the membrane.

7. The assembly of claim 6, wherein the curable support layer is a first curable support layer, wherein the assembly further comprises a second curable support layer, wherein the second curable support layer is bonded to the second side of the membrane along the periphery of the second side of the membrane opposite the first curable support layer.

8. The assembly of claim 7, further, wherein the second curable support layer comprises a thermoset polymer.

9. The assembly of claim 1, wherein the membrane is microporous.

10. The assembly of claim 1, wherein the assembly has an insertion loss peak of not greater than 1 dB at 4 kHz when the assembly is subjected to a compressive force of 10 N.

11. The assembly of claim 1, wherein the assembly has an insertion loss peak of not greater than 1 dB at 4 kHz when the assembly is subjected to a compressive force of 15 N.

12. The assembly of claim 1, wherein the curable support layer reversibly deforms to a 0.5 mm strain when subjected to a shear force greater than 8.0 kg force.

13. The assembly of claim 1, wherein the curable support layer is resistant to creep, such that the curable support layer deforms by 90 microns or less.

14. An acoustic device comprising an assembly according to claim 1, wherein the acoustic device is a micro-electric mechanical (MEMS) microphone, a transducer, an acoustic sensor, or an acoustic speaker.

15. The assembly of claim 4, the curable support layer has a stiffness of 8,000 gf to 12,900 gf, at a strain of 0.5 mm.

16. The assembly of claim 5, wherein the at least one layered assembly defines a ring shape that surrounds the acoustic cavity.

17. The assembly of claim 9, wherein the membrane comprises one of a polyester, polyethylene, fluoropolymer, polyurethane, or silicone.

18. The assembly of claim 13, wherein the curable support layer is resistant to creep, such that the curable support layer deforms by 23 microns or less when subjected to a shear force of 2.5 kgf for a duration of at least 10 minutes.

19. The assembly of claim 13, wherein the curable support layer is resistant to creep, such that the curable support layer deforms by 11 microns or less when subjected to a shear force of 2.5 kgf for a duration of at least 10 minutes.

* * * * *